US011925246B2

(12) United States Patent
Treadway

(10) Patent No.: US 11,925,246 B2
(45) Date of Patent: Mar. 12, 2024

(54) TRIMMING GUIDE

(71) Applicant: David Michael Treadway, Troy, OH (US)

(72) Inventor: David Michael Treadway, Troy, OH (US)

( * ) Notice: Subject to any disclaimer, the term of this patent is extended or adjusted under 35 U.S.C. 154(b) by 0 days.

(21) Appl. No.: 17/548,512

(22) Filed: Dec. 11, 2021

(65) Prior Publication Data

US 2023/0180910 A1 Jun. 15, 2023

(51) Int. Cl.
*A45D 24/36* (2006.01)

(52) U.S. Cl.
CPC ..... *A45D 24/36* (2013.01)

(58) Field of Classification Search
CPC ..... A45D 24/00; A45D 24/36; A45D 2/38; A45D 2/46; A45D 8/10
See application file for complete search history.

(56) References Cited

U.S. PATENT DOCUMENTS 2,642,880 A * 6/1953 Corette ..... A45D 8/40 132/274
2,698,018 A * 12/1954 Warner ..... A45D 24/36 132/141
3,180,341 A * 4/1965 Dumont ..... A45D 24/36 132/213
3,202,158 A * 8/1965 Dumont ..... A45D 24/36 D28/44.2
3,407,823 A * 10/1968 Selvaggio ..... A45D 24/36 132/214
3,452,761 A * 7/1969 Irving ..... A45D 8/38 132/106
3,972,075 A * 8/1976 Alevras ..... A45D 4/02 D28/44.2
4,106,515 A * 8/1978 Miller ..... A45D 24/36 132/214
4,137,925 A * 2/1979 Castillo ..... A45D 24/36 132/214
2022/0160097 A1* 5/2022 Sexton ..... A45D 24/36

* cited by examiner

*Primary Examiner* — Cris L. Rodriguez
*Assistant Examiner* — Karim Asqiriba
(74) *Attorney, Agent, or Firm* — Robert R. Lech; Lech Law, LLC

(57) ABSTRACT

The present invention relates generally to a trimming guide to enable a person with or without particular skill, or a robot, or a computer, or a numerical device to cut a predetermined design, style or shape. More particularly, the invention relates to a trimming guide that would enable a person by him or herself, with or without training or particular skill, or through the use of a robot or a computer or a numerical device to trim his or her own hair, or another person's hair to a quality, finished state which is a predetermined design, style or shape.

1 Claim, 9 Drawing Sheets

TRIMMING GUIDE

CROSS-REFERENCE TO RELATED APPLICATIONS

This application claims the benefit of PPA Application No. 63/124,351, filed Dec. 11, 2020, by David M Treadway, titled Perfect Haircut which is incorporated by reference as well as No. 63/195,108, filed May 31, 2021, by David M Treadway, titled Trimming Guide.

FIELD OF INVENTION

The present invention relates generally to a trimming guide to enable a person with or without particular skill, or a robot, or a computer, or a numerical device to cut a predetermined design, style or shape. More particularly, the invention relates to a trimming guide that would enable a person by him or herself, with or without training or particular skill, or through the use of a robot or a computer or a numerical device to trim his or her own hair, or another person's hair to a quality, finished state which is a predetermined design, style or shape.

BACKGROUND

Haircutting is a well-known art. However, it is also well known that the outcome of a haircut varies widely based on the person who performs the cut. Thus, often cuts are not performed to a person's satisfaction.

Trimming material, such as hair, into a certain style, shape or design ordinarily takes considerable skill, training and often a license to achieve a quality finished product. Getting a highly uniform product requires inconvenience and great expense. Taking the matter into one's own hands is almost an impossible proposition due to various considerations including required skill and physical accessibility. Several inventions have tried to aid one in this effort, but none have come close to solving the challenges. Examples include U.S. Pat. Nos. 3,972,075; 2,915,070; 3,230,619; 4,716,914; 5,865,192; and 3,972,075 among others.

There are many significant problems that the present invention addresses and solves. The first problem is quality. For a variety of reasons, getting one's haircut often results in extremely poor results even when paying a licensed professional to do the job. Barbers or hairstylists are often in a rush to cut as many haircuts as possible to maximize income. This often leads to terrible results such as uneven cut, uncut sections, etc. There is also a variety of skill in the industry and newer or careless, licensed persons do not achieve a quality cut. The result of a simple haircut between two stylists can by dramatic from a very professional cut to an embarrassing mess. Unless a person has a history with a stylist, you do not know whether you are going to get a quality cut or a disappointing result. Many people who get to know and trust a stylist go to great lengths to keep a working relationship including paying a high economic cost or driving long distance to see the person. The spectrum of quality is large and options to maintain high quality are problematic.

Another problem common to getting a haircut is inconvenience. To get a haircut at a barber or salon, one generally must make an appointment or drop in and be a walk-in with an unknown wait time. One may also have to wait a long time for an appointment or must take time off work to see a specific stylist. All of these scenarios are inconvenient and can be problematic to people needing to look professional or to attend certain events (i.e. business travel, weddings, interviews, etc) or simply personal preference. Many people's hair begins to look untidy after just mere days after getting a trim and going to a salon every week is impractical, inconvenient and expensive.

Yet another problem with frequent haircuts or for a large family is the cost. Most people require many haircuts every year which can add up in cost. Add to that the cost for cutting hair for an entire family and this can put a strain on families.

Another problem many parents encounter is getting their child(ren) to get their haircut. Many children balk at the idea of getting their hair cut or have trouble sitting and waiting in a traditional barber.

And lastly, hair salons and barbers present a challenge concerning health, safety and sanitation. Using trimming tools on many people in a single day presents inherent challenges for health and safety via cross contamination. Without constant sterilization practices, fungi, parasites, bacteria and bacteria can easily spread and cause infection. Due to close contact and usually smaller buildings recent virus transmission by airborne viruses such as Coronavirus is a major health concern.

A guide to enable one without skill to trim hair is needed that would enable one to trim his or her own or another's hair without wait, inconvenience, cost, health, or quality issues. While this invention may be described in relation to a trimming guide for a person's hair, it is contemplated that it could be adapted for use in trimming away any type of unwanted material. For example, it could be used to trim a dog's hair, livestock, or a bush, tree, flowers or hedges.

OBJECTS AND ADVANTAGES

One great advantage is that the trimming guide allows a person to cut a high-quality, hair style of him or herself or another exactly the same way every time without any training or skill. Another advantage is that a person can do this conveniently in little time when it fits his or her schedule. Yet another advantage is that there will not be a recurring cost to use the trimming guide. Once a user acquires a trimming guide, he/she can use it an infinite number of times without any additional cost, as frequently as desired. A person can use the guide often to maintain a neatly trimmed haircut and neckline, not having to go to a salon to get a trim. Also, a trusted parent can use the guide to quickly trim a child's hair without the inconvenience and discomfort that children often face at a salon. The guide can also be used anywhere and under controlled conditions such as one's own home preventing the possible cross contamination of using the guide on a lot of different people.

SUMMARY

In accordance with one aspect of the present invention, the disclosure herein relates generally to a trimming guide. More specifically, the disclosure herein pertains to a trimming guide for cutting one or another's hair to a predetermined shape, style or design. The guide may enable trimming of all or part of the shape, style or design, including, if desired, the finishing trimming around the nape of the neck, ears, sideburns or bangs. In the case of a guide used for a haircut, this could be used for the haircut itself or solely for finishing trimming around sideburns, around ears and at the nape of the neck as the user desires. The guide can enable the complete haircut with finishing trimming as well.

One exemplary embodiment of a trimming guide may include a top, bottom, front and back and sides with openings of any shape in the guide to allow for protrusion of material to be cut away, including finishing trimming around the perimeter of the guide to finish the nape of the neck, sideburns or bangs. Another embodiment allows trimming of specific designs down to and including removal of all of the hair in specific locations. For example, the guide may enable the removal of all hair in a specific shape, such as a lightning bolt on the side of the head or anywhere else desired. The guide may also enable solely trimming away of unwanted material at the outermost edges, such as at sideburns, around ears, on bangs or on the nape of the neck or in combination with the haircut itself into a predetermined design, style or shape.

It should be understood that any description or specific examples described herein are not intended to describe each embodiment or every implementation of the present disclosure. The descriptions and examples are intended for purposes of illustration only and are not intended to limit the scope of the invention. A more complete understanding will become apparent and appreciated by referring to the following brief and detailed descriptions as well as the claims taken in conjunction with the accompanying drawings.

BRIEF DESCRIPTION OF THE DRAWINGS

The present invention will become more fully understood from the detailed description and the accompanying drawings. The drawings constitute a part of the specification and include exemplary embodiment of the invention, which may be embodied in various forms. It is to be understood that in some instances, various aspects of the invention may be shown exaggerated or enlarged to facilitate an understanding of the invention; therefore, the drawings are not necessarily to scale.

DETAILED DESCRIPTION

Figure 1:
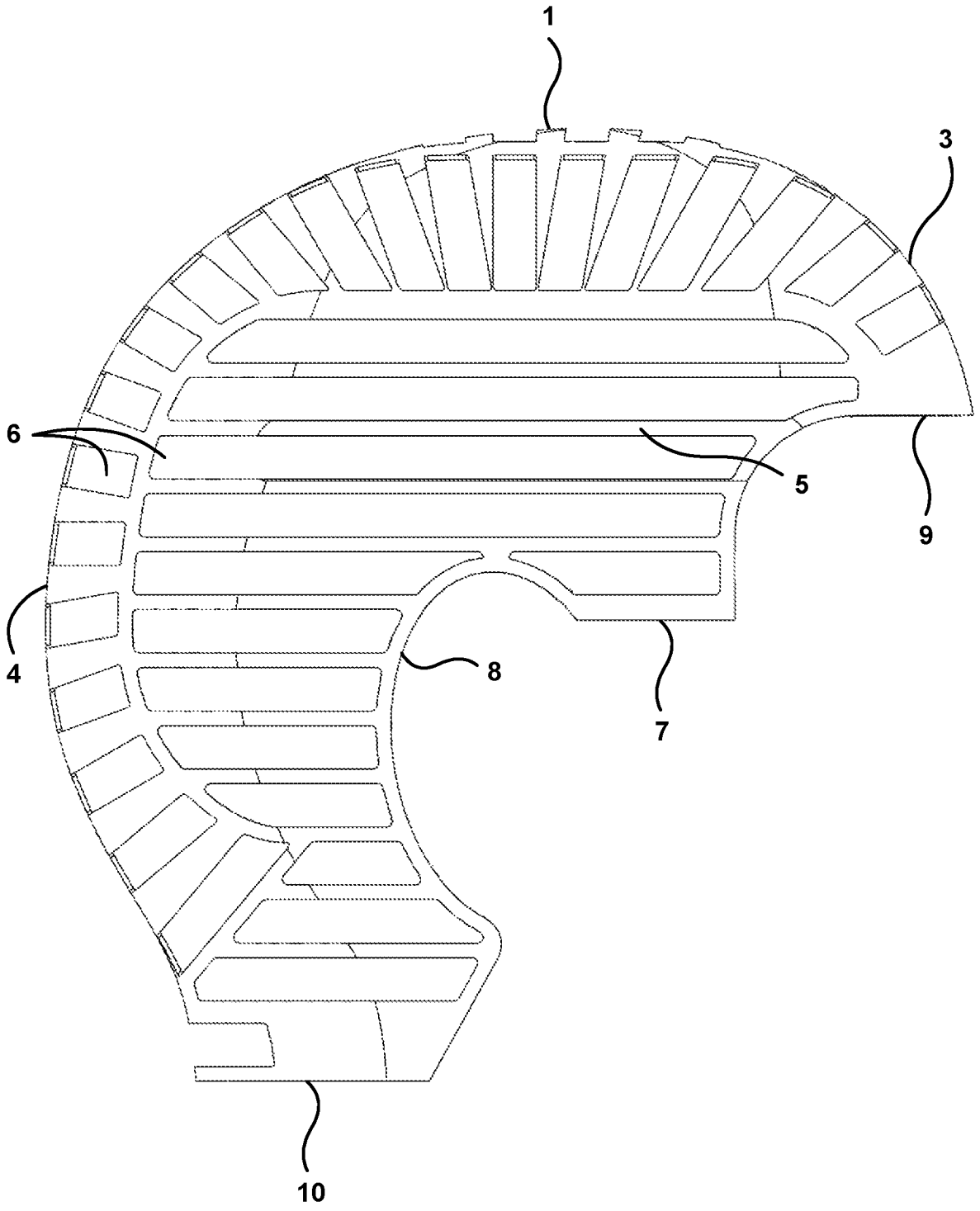
FIG. 1 is a side schematic view of an first exemplary embodiment of a trimming guide of the present invention.
Figure 2:
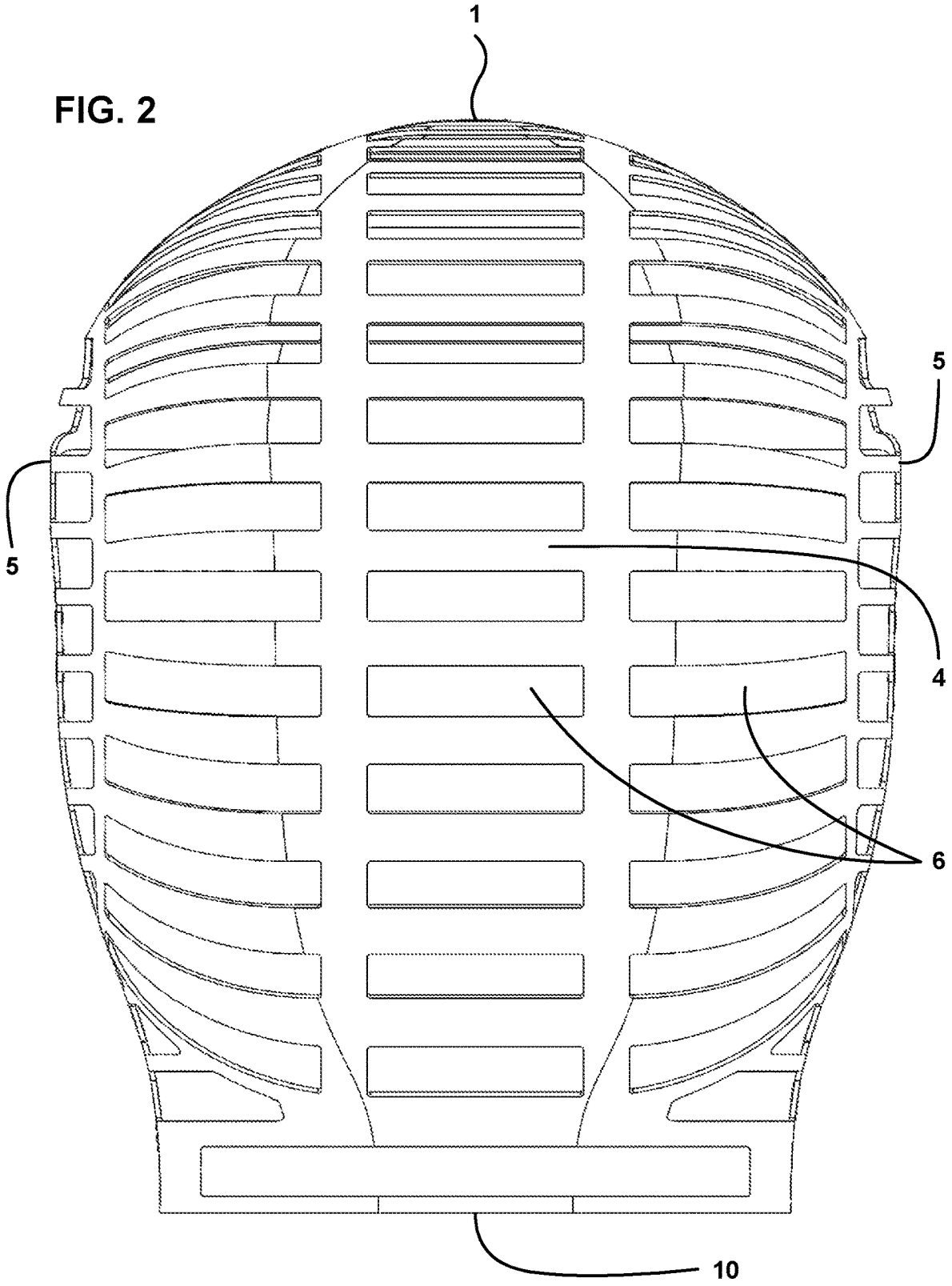
FIG. 2 is a rear schematic of an first exemplary embodiment of a trimming guide of the present invention.
Figure 3:
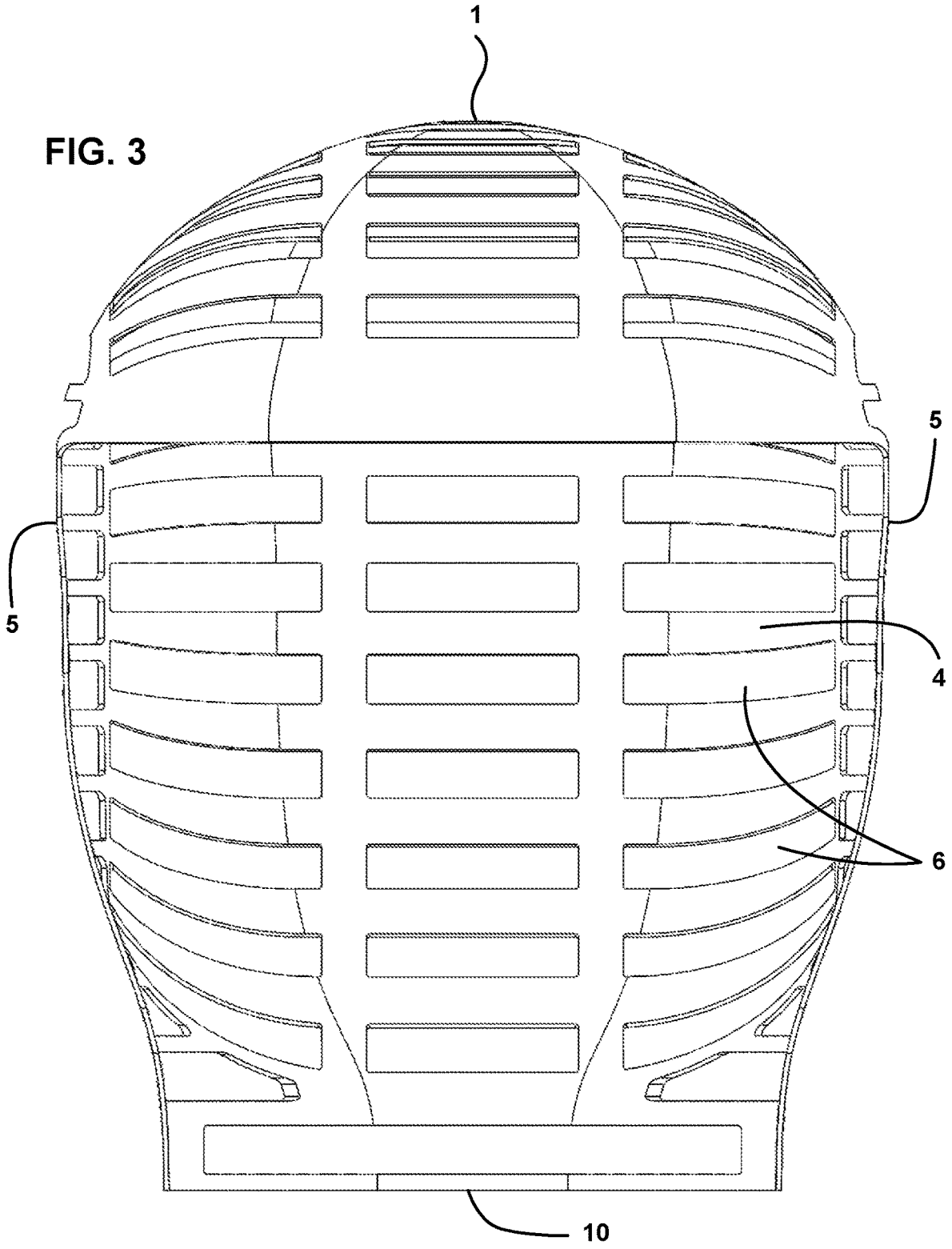
FIG. 3 is a front schematic of an first exemplary embodiment of a trimming guide of the present invention.
Figure 4:
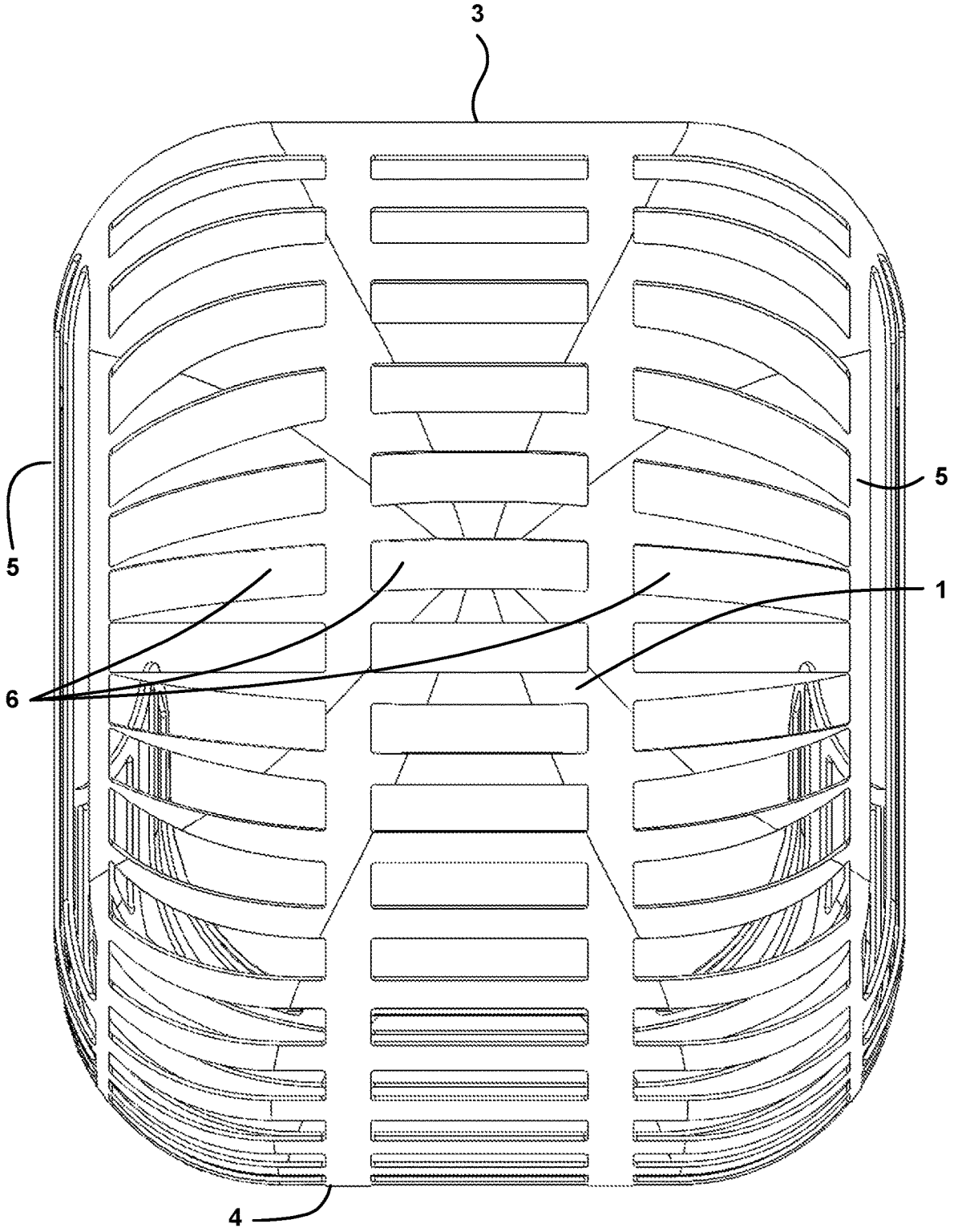
FIG. 4 is a top schematic of an first exemplary embodiment of a trimming guide of the present invention.
Figure 5:
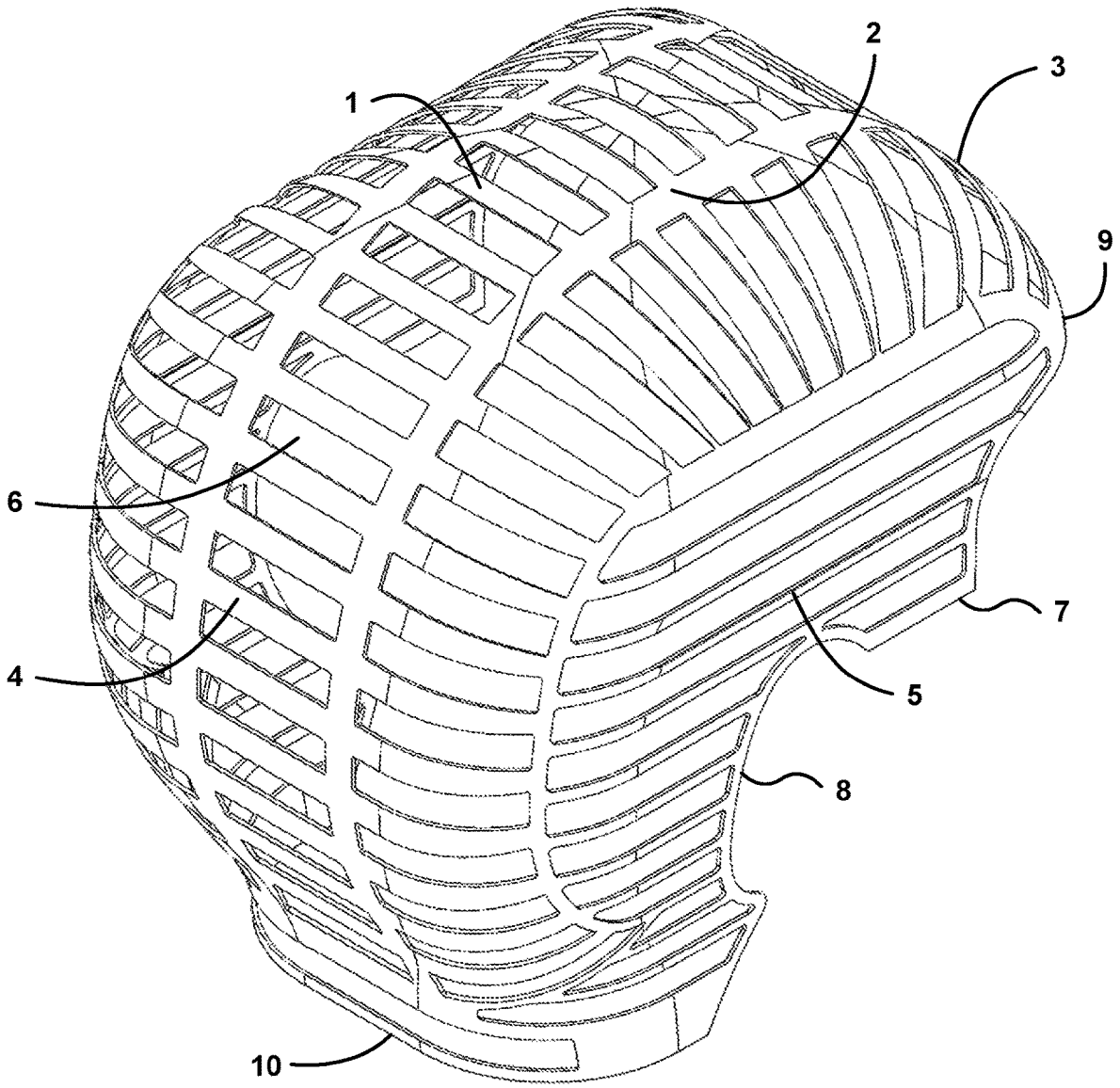
FIG. 5 is an isometric rear schematic of an first exemplary embodiment of a trimming guide of the present invention.
Figure 6:
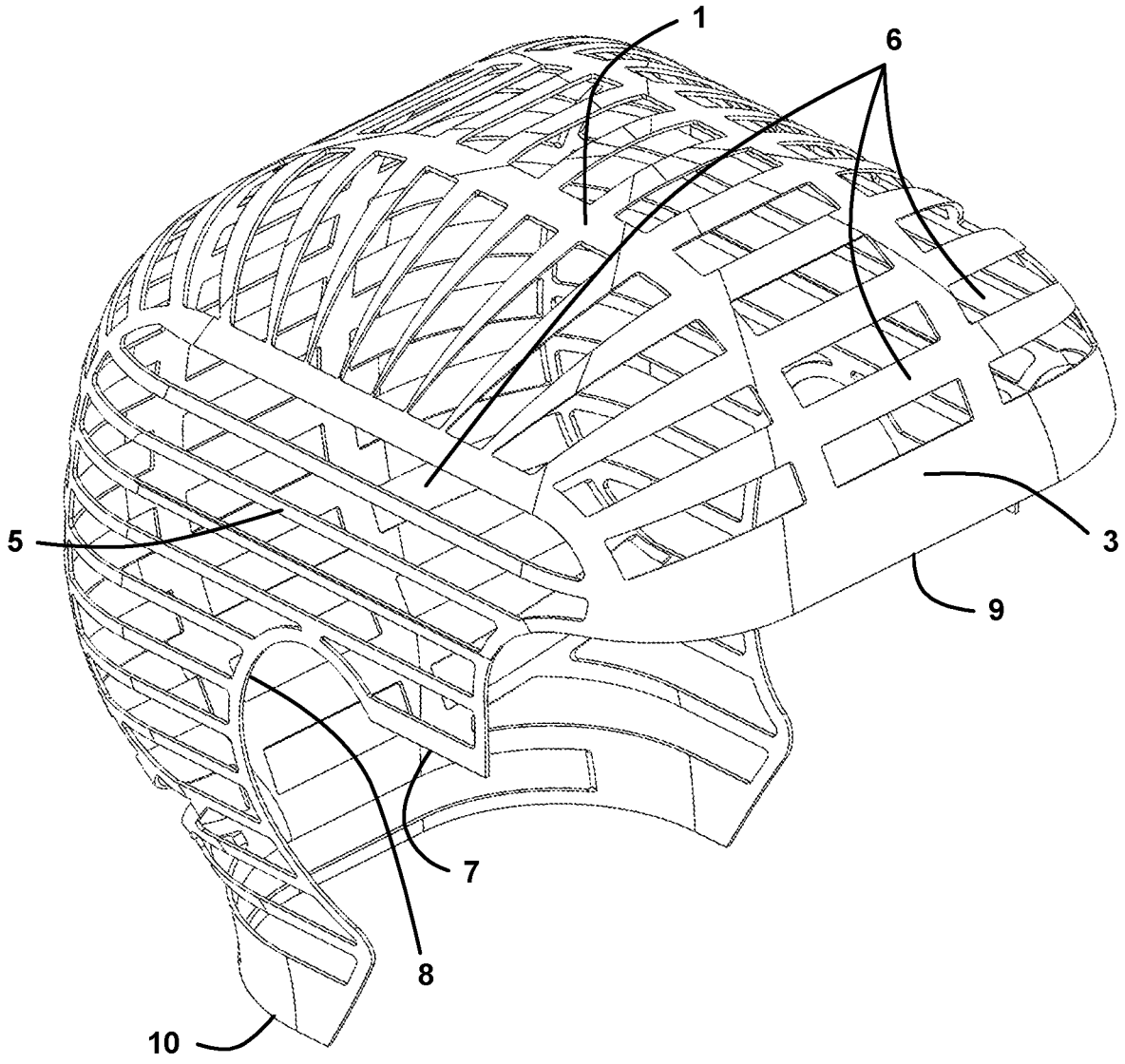
FIG. 6 is an isometric front schematic of an first exemplary embodiment of a trimming guide of the present invention.

The following description of the various embodiments are merely exemplary in nature and in no way intended to limit the invention, its application or uses. In the following detailed description of the illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary trimming guides shall generally be described with reference to FIGS. 1-9. It will be apparent to one skilled in the art that elements from one embodiment may be used in combination with elements of the other embodiments, and that the possible embodiments using features set forth herein are not limited to the specific embodiments described. Further. It will be recognized that the embodiments described herein will include many elements that are not necessarily shown to scale. Further, it will be recognized that the size and shape of various elements herein may be modified without departing from the scope of the present disclosure, although one or more shapes and sizes may be advantageous over others.

Referring to the FIGS. 1-6, the trimming guide has a top (1), a bottom (2), a front (3), a back (4) and sides (5). The trimming guide depicted in FIGS. 1-6 is conformed to the approximate size of the human head so as to fit snugly and hug the head of the user, thus allowing hair to protrude through the openings (6) for trimming. The size may be altered to fit persons with different sized heads. For example, there can be smaller sizes for children as well as different sized adult guides for persons with smaller or larger heads. The trimming guide is shaped so as to allow for final trimming of varying length, shape and style below the sideburns (7), around the ears (8), in the front of the head area for example for bangs (9), and at the nape of the neck (10).

Figure 7:
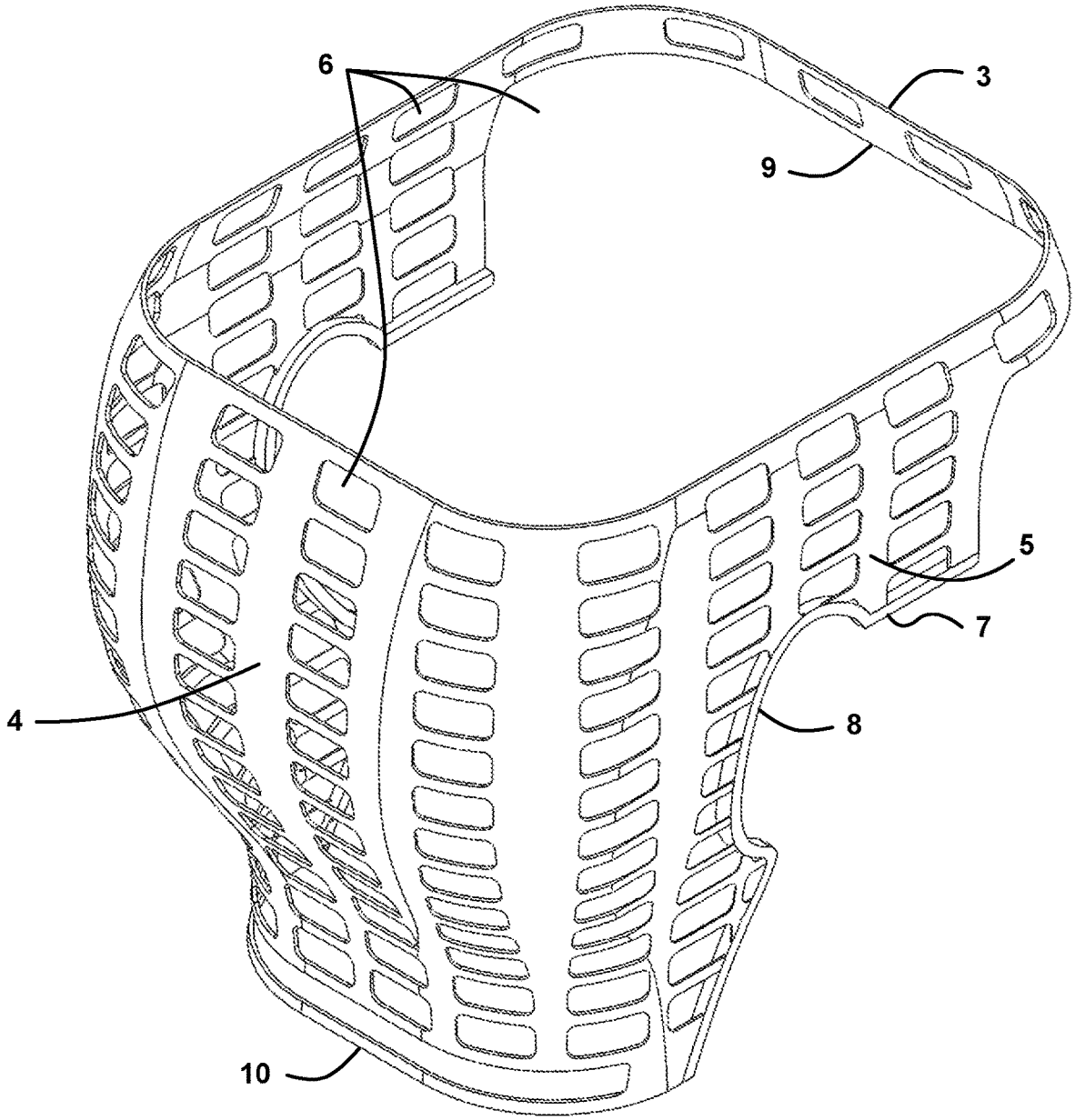
FIG. 7 is an isometric rear schematic of an second exemplary embodiment of a trimming guide of the present invention.

FIG. 7 shows an embodiment where the top is left open for either unaltered styling or free form styling on the top of the head. The embodiment also would allow for a uniform trim on the top of the head using a trimming guide of any length or scissors. For example, clippers with a uniform guide could be used for the top portion of the head.

Figure 8:
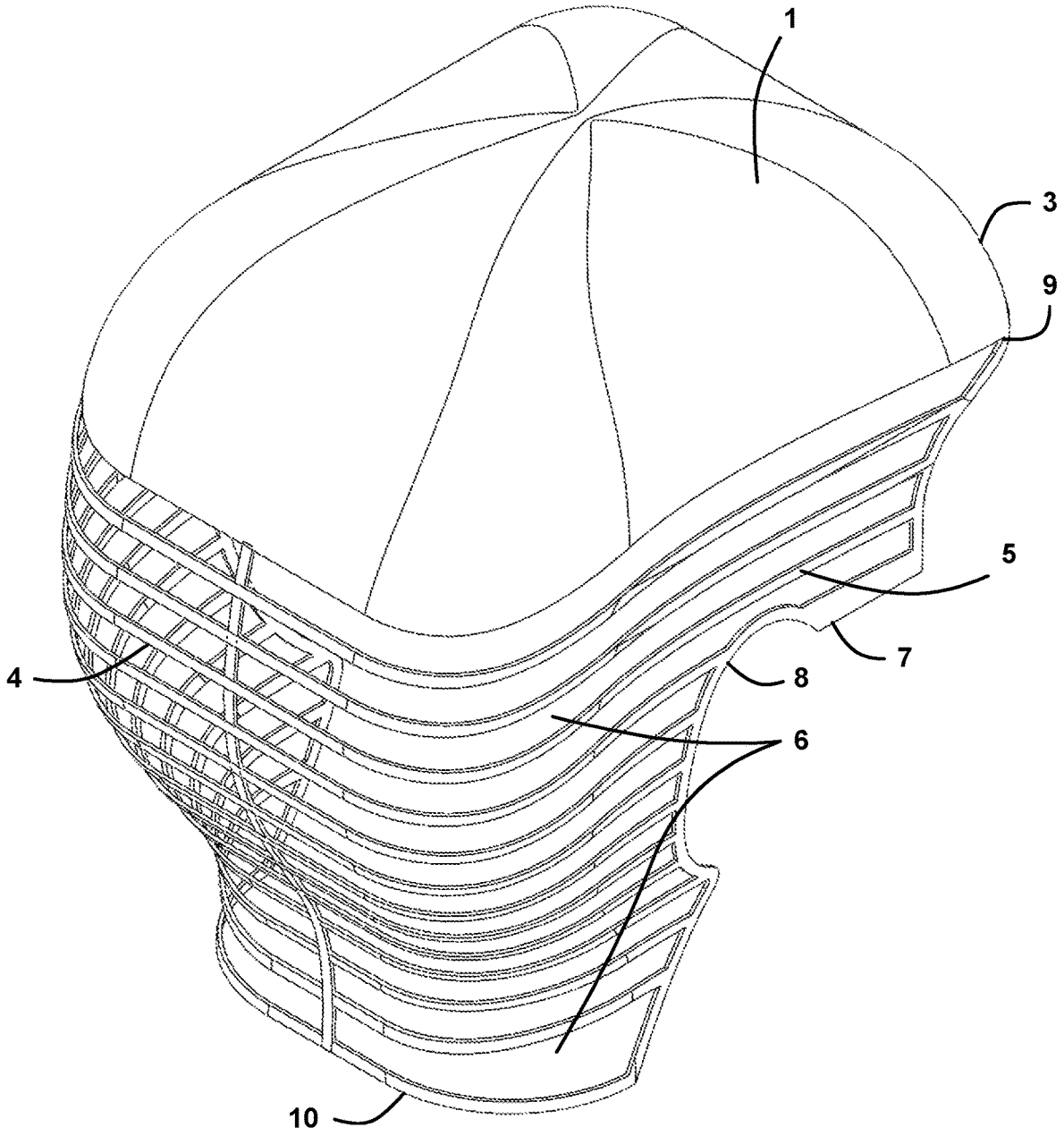
FIG. 8 is an isometric rear schematic of an third exemplary embodiment of a trimming guide of the present invention.

FIG. 8 shows an embodiment where the top is solid allowing for either unaltered styling or free form styling once the trimming guide is used and removed. The embodiment also would allow for a uniform trim on the top of the head using a trimming guide of any length or scissors. For example, clippers with a uniform guide could be used for the top portion of the head.

Figure 9:
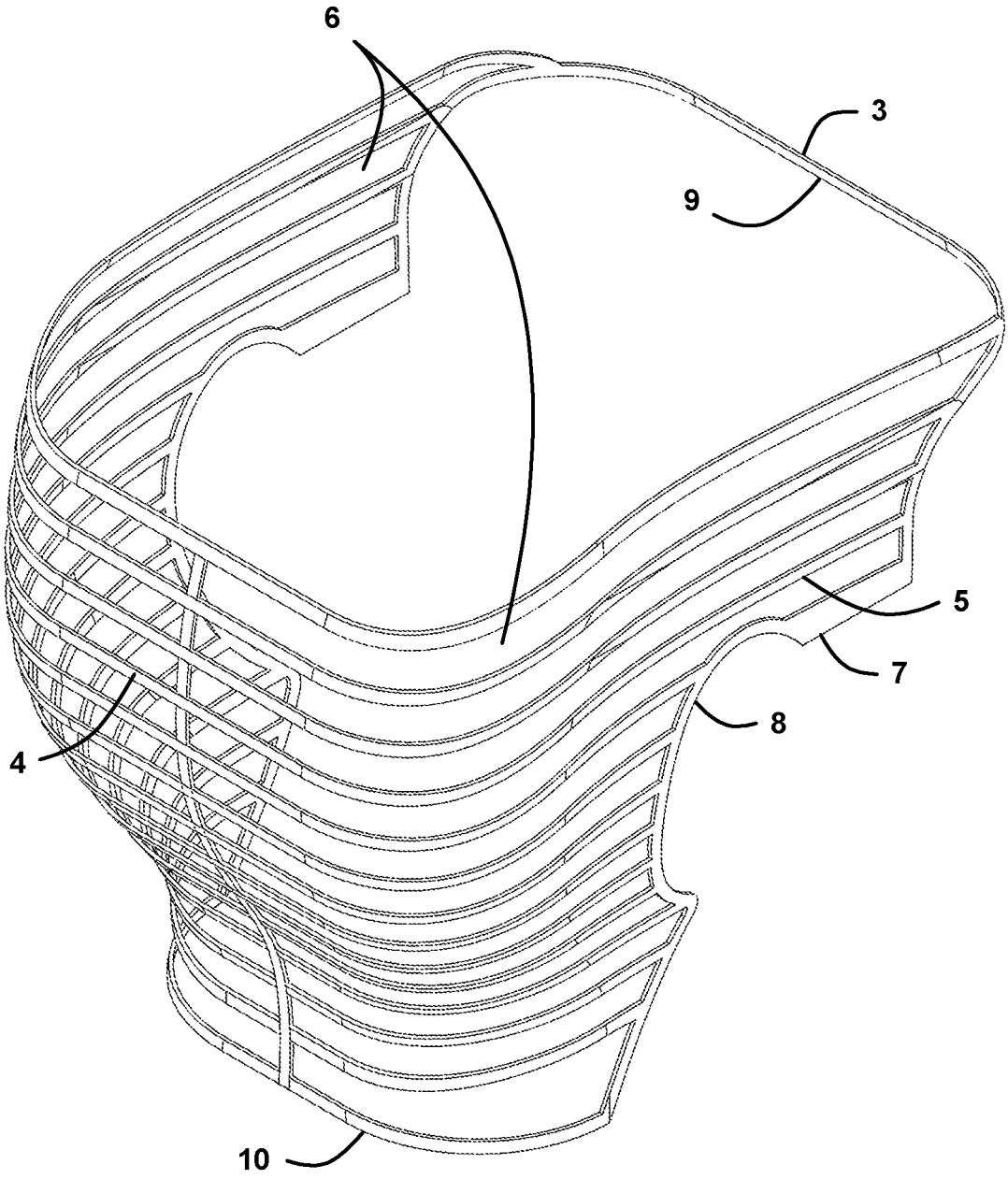
FIG. 9 is an isometric rear schematic of an fourth exemplary embodiment of a trimming guide of the present invention.

FIG. 9 shows another embodiment where the top of the guide is left open for either unaltered styling, free form styling, or styling using another means of trimming. The embodiment also would allow for a uniform trim on the top of the head using a trimming guide of any length or scissors. For example, clippers with a uniform guide could be used for the top portion of the head.

What is claimed is:

1. A trimming guide configured to stretch and contract upon securing around a person's head, thereby conforming to contours of the person's head and minimizing gaps between the trimming guide and the person's head, the trimming guide comprises a top, a back, a front, sides, and an outer edge to outline a trimming style, the top of the trimming guide comprises a solid covering without any apertures, thereby preventing any trimming of the top portion of a material while the trimming guide is in use, the sides and back of the trimming guide define a plurality of lateral, elongated openings through which material may pass, a portion of the lateral, elongated openings extend between the back and one of the sides, whereby at least a portion of the material may be trimmed, resulting in a predetermined shape of the remaining material.

* * * * *